US009248497B2

(12) United States Patent
Vincent

(10) Patent No.: US 9,248,497 B2
(45) Date of Patent: Feb. 2, 2016

(54) METAL TRANSFER DEVICE

(75) Inventor: Mark Vincent, Bedfordshire (GB)

(73) Assignee: Pyrotek Engineering Materials Limited, Milton Keynes (GB)

( * ) Notice: Subject to any disclaimer, the term of this patent is extended or adjusted under 35 U.S.C. 154(b) by 98 days.

(21) Appl. No.: 14/006,457

(22) PCT Filed: Jun. 18, 2012

(86) PCT No.: PCT/GB2012/000524

§ 371 (c)(1),
(2), (4) Date: Sep. 20, 2013

(87) PCT Pub. No.: WO2012/175911

PCT Pub. Date: Dec. 27, 2012

(65) Prior Publication Data

US 2014/0008399 A1 Jan. 9, 2014

(30) Foreign Application Priority Data

Jun. 21, 2011 (GB) ..... 1110511.1

(51) Int. Cl.

| | |
|---|---|
| ***B22D 35/04*** | (2006.01) |
| ***B22D 41/01*** | (2006.01) |
| ***B22D 41/02*** | (2006.01) |
| ***F27D 1/00*** | (2006.01) |
| ***F27D 3/14*** | (2006.01) |

(52) U.S. Cl.

CPC ..... *B22D 35/04* (2013.01); *B22D 41/01* (2013.01); *B22D 41/02* (2013.01); *F27D 1/0006* (2013.01); *F27D 3/145* (2013.01)

(58) Field of Classification Search

CPC ..... B22D 35/04; B22D 41/01; B22D 41/02
USPC ..... 266/242, 196
See application file for complete search history.

(56) References Cited

U.S. PATENT DOCUMENTS

| | | | | |
|---|---|---|---|---|
| 6,090,340 | A * | 7/2000 | Boonacker et al. | 266/46 |
| 6,994,148 | B1 | 2/2006 | McKibben | |
| 8,657,164 | B2 | 2/2014 | Reeves et al. | |
| 2010/0109210 | A1 * | 5/2010 | Vincent | 266/242 |
| 2010/0301073 | A1 | 12/2010 | Kim | |
| 2011/0140318 | A1 | 6/2011 | Reeves | |
| 2011/0168707 | A1 * | 7/2011 | Reeves | 220/211 |

FOREIGN PATENT DOCUMENTS

| | | |
|---|---|---|
| JP | 9-004988 | 1/1997 |
| JP | 9-155512 | 6/1997 |

(Continued)

OTHER PUBLICATIONS

International Search Report issued in PCT/GB2012/000524 on Sep. 13, 2012.

(Continued)

*Primary Examiner* — Scott Kastler
(74) *Attorney, Agent, or Firm* — Knobbe Martens Olson & Bear LLP

(57) ABSTRACT

A metal transfer device (1) includes a cast trough body (2) for receiving liquid metal, a heater (4) for heating the trough body, and a filler layer (6) between the trough body and the heater. The filler layer (6) comprises a cast refractory material having a high thermal conductivity.

11 Claims, 2 Drawing Sheets

(56) References Cited

FOREIGN PATENT DOCUMENTS

| | | |
|---|---|---|
| JP | 2001-021271 | 1/2001 |
| WO | WO 2008/074134 A1 | 6/2008 |

OTHER PUBLICATIONS

Search Report issued in Great Britain Application No. 1110511.1 on Oct. 19, 2011.

* cited by examiner

METAL TRANSFER DEVICE

RELATED APPLICATIONS

This application is the U.S. National Phase filing under 35 U.S.C. §371 of PCT/GB2012/000524, filed Jun. 18, 2012, which designated the United States and was published in English as WO 2012/175911 on Dec. 27, 2012, which claims priority under 35 U.S.C. §119(a)-(d) to Great Britain Patent Application No. 1110511.1, filed Jun. 21, 2011, the entire content of which is incorporated herein by reference.

FIELD OF THE INVENTION

The present invention relates to a metal transfer device for transferring liquid metals and in particular, but not exclusively, for transferring metals such as aluminium, zinc and alloys of these and other non-ferrous metals.

BACKGROUND OF THE INVENTION

Metal transfer devices known as "launders" are widely used for transferring liquid metal in metal refining and processing plants, for example from a furnace to a mould. A typical launder comprises a trough made of a refractory material, through which the metal flows under the influence of gravity.

SUMMARY OF THE INVENTION

Launders may be either unheated or heated. Heated launders are preferred for certain applications, as they help to maintain the temperature of the metal as it is transferred. Preheating the launder also reduces the thermal shock on the refractory material as the liquid metal is introduced, thereby reducing the risk of cracking.

An example of a heated launder is described in US patent application Publication No. 2010/0109210 A1. This device includes a trough body for carrying liquid metal, a heating element positioned adjacent the trough body, an insulating layer and an outer shell defined by a bottom and two side walls. The trough body is made of a thermally conductive castable refractory material, which allows heat to be transferred from the heating elements to the liquid metal. The thermal conductivity of this layer depend on the refractory material from which it is made, being in the range of about 9 to 11 W/m·K for silicon-carbide based refractories, but only about 1.5 to about 1.9 W/m·K for alumina-based refractories. As a result, the efficiency of heat transfer is limited, particularly with alumina-based refractories.

Another problem is that if the trough body cracks, it may be possible for liquid metal to leak through to the heating elements, which could be damaged by contact with the liquid metal.

It is an object of the present invention to provide a metal transfer device that mitigates at least one of the aforesaid disadvantages.

According to one aspect of the present invention there is provided a metal transfer device comprising a cast trough body that comprises a vessel for receiving liquid metal, a heater for heating the trough body, and a filler layer between the trough body and the heater, said filler layer comprising a cast refractory material having a high thermal conductivity.

The filler layer ensures efficient transfer of heat from the heater to the trough body. It also enables to use of different materials for the trough body, according to the intended application of the metal transfer device. For example, the material of the trough body can be chosen to provide high thermal conductivity, high thermal shock resistance or high wear resistance. The device can therefore be used with a variety of different metals in numerous different applications.

The filler layer also provides a barrier to leaking metal, preventing it from reaching the heater and other non-sacrificial components of the metal transfer device in the event that the trough body develops a leak.

Advantageously, the cast refractory material of the filler layer has a thermal conductivity of at least 3 W/m·K, preferably at least 5 W/m·K, more preferably at least 7 W/m·K.

In a preferred embodiment, the refractory material of the filler layer is based on silicon carbide. Preferably, the filler material has a high proportion of silicon carbide, for example greater than 75% by weight. It may also include other materials such as alumina and/or metal fines for increased thermal conductivity. In a preferred embodiment, the filler layer is a ram-filled cast refractory.

In a particularly preferred embodiment, the metal transfer device includes a detector for detecting leakage of liquid metal. This may be used to alert an operator to a leakage, who can then take steps to repair the leak before the leaking metal causes substantial damage to the heater or other non-sacrificial components of the device.

The detector preferably comprises an electrically conductive element. The detector is preferably located adjacent an outer surface of the trough body. Advantageously, the detector is embedded within the filler layer.

Preferably, the metal transfer device includes a metallic shell between the filler layer and the heater. The metallic shell provides an additional barrier to leaking metal, preventing it from reaching the heater and other non-sacrificial components of the metal transfer device in the event that the trough body develops a leak. It is also supports the trough body and the filler layer.

In a preferred embodiment, the metallic shell and any components of the device located internally of the shell are constructed and arranged to be separable from any components of the device located externally of the shell. This allows them to be readily replaced.

According to another aspect of the present invention there is provided a metal transfer device including a cast trough body that comprises a vessel for receiving liquid metal, a heater for heating the trough body, and a detector for detecting leakage of liquid metal from the trough body. The detector may be used to alert an operator to a leakage, who can then take steps to repair the leak before the leaking metal causes substantial damage to the heater or other non-sacrificial components of the device.

The detector preferably comprises an electrically conductive element. The detector is preferably located adjacent an outer surface of the trough body.

The metal transfer device may include a filler layer between the trough body and the heater, said filler layer comprising a cast refractory material having a high thermal conductivity, and wherein the detector is embedded within the filler layer.

Advantageously, the refractory material of the filler layer has a thermal conductivity of at least 3 W/m·K, preferably at least 5 W/m·K, more preferably at least 7 W/m·K.

In a preferred embodiment, the refractory material of the filler layer is based on silicon carbide.

The metal transfer device may include a metallic shell between the filler layer and the heater.

The metallic shell and any components of the device located internally of the shell may be constructed and arranged to be separable from any components of the device located externally of the shell.

The metal transfer device preferably includes an outer casing located externally of the heater.

The metal transfer device preferably includes an insulating layer located between the heater and the outer casing.

The metal transfer device preferably includes an air gap between the insulating layer and the outer casing. This allows the position of the heater or heaters to be adjusted and allows the trough and filler layer to be removed and replaced.

The metal transfer device preferably includes a top cover. The device preferably includes an insulating layer located beneath the top cover.

BRIEF DESCRIPTION OF THE DRAWINGS

Certain embodiments of the invention will now be described by way of example with reference to the accompanying drawings, in which.

DETAILED DESCRIPTION OF THE PREFERRED EMBODIMENT

Figure 1:
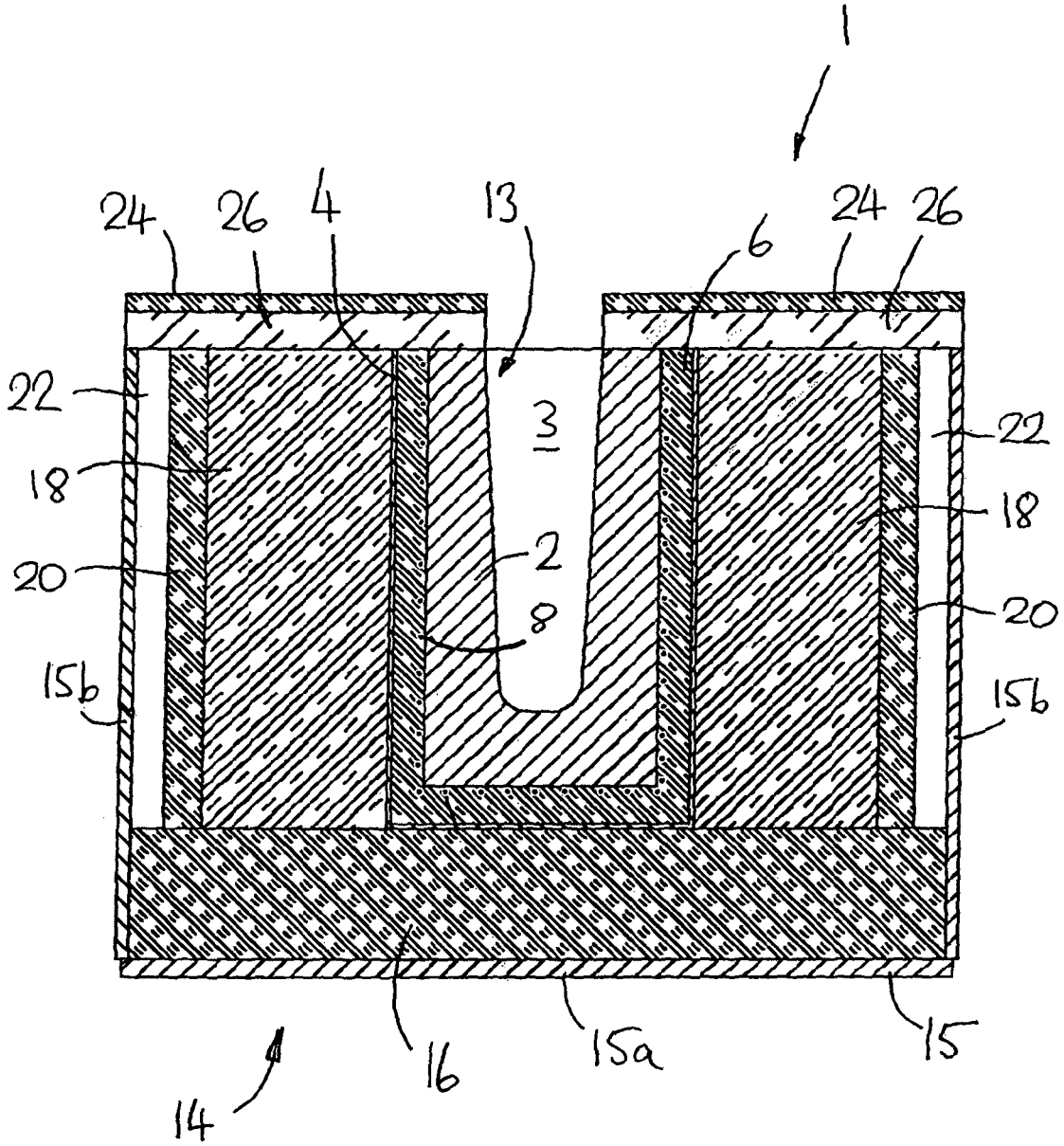
FIG. 1 is a cross-sectional view through a metal transfer device.
Figure 2:
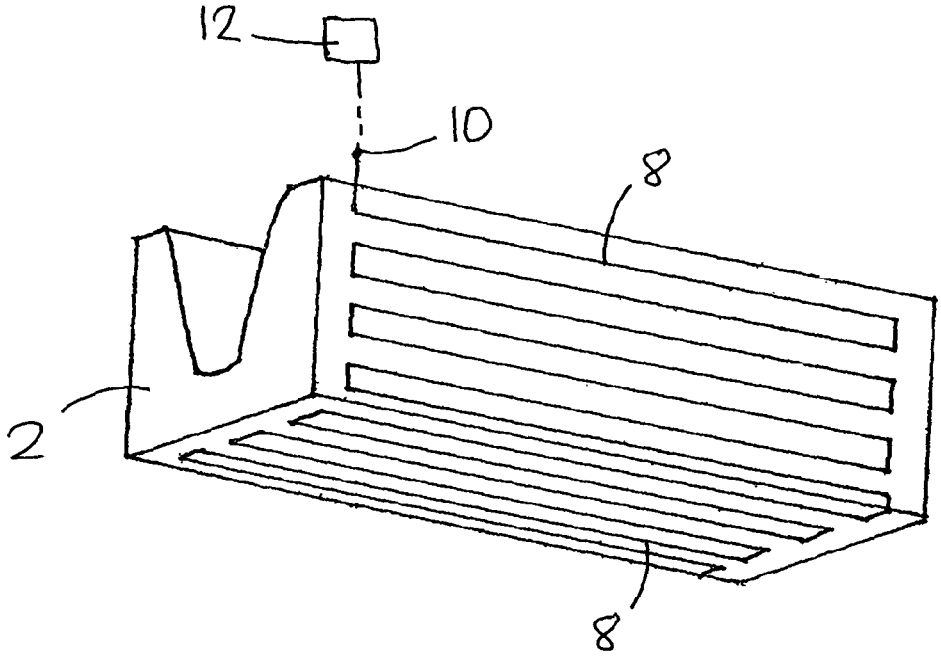
FIG. 2 is an isometric view of a trough body, comprising part of the metal transfer device of FIG. 1.

The metal transfer device 1 shown in FIGS. 1 and 2 comprises a launder: that is, it consists of a trough through which liquid metal can be poured, for example from a furnace to a mould. The device is elongate and has a substantially uniform transverse cross-section as shown in FIG. 1.

The metal transfer device 1 includes a trough body 2 comprising a vessel in the form of a U-shaped trough for receiving liquid metal. The trough body 2 defines an open-topped channel 3 for containing the liquid metal as it flows through the device. The trough body 2 is preferably made of a cast refractory material. For example, the trough body may be made of fused silica ($SiO_2$) or alumina ($Al_2O_3$), according to the application for which the device is intended.

The trough body 2 is located centrally within a U-shaped metallic shell 4 that is made, for example, of stainless steel. The shell 4 is wider and deeper than the trough body 2, leaving a gap around the sides and base of the body. This gap is preferable ram-filled with a thermally conductive castable refractory material forming a filler layer 6. The filler layer 6 is preferably made of a castable refractory material having a high thermal conductivity: that is, a thermal conductivity of at least 3 W/m·K, preferably at least 5 W/m·K and more preferably at least 6.5 W/m·K.

For example, the filler material may be Pyrocast™ SCM-2600 sold by Pyrotek, Inc. This is a high purity silicon carbide based castable refractory with low cement content. It has a thermal conductivity of 7.19 W/m·K at 816° C.

More generally, the filler material may be silicon carbide based castable refractory with a high percentage of silicon carbide, for example about 80% silicon carbide by weight. The refractory may also contain other materials such as metallic fines for increased thermal conductivity.

Other materials such as aluminium nitride can also be used, either as the main component of the filler material or included as an additional component within a silicon carbide based refractory. Aluminium nitride has an extremely high thermal conductivity but is very expensive and so its use may be limited to only the most demanding applications.

Materials having slightly lower thermal conductivities, such as alumina and silicon nitride, may also be used in less demanding applications.

A detector 8 for detecting leakage of liquid metal from the trough body 2 is provided adjacent an outer surface of the trough body 2. The detector comprises an electrical conductor, for example a wire, that is embedded within the filler layer 6 at the surface of the trough body 2. The detector wire 8 is wrapped backwards and forwards over substantially the entire outer surface of the trough body so that a leak in any part of the trough can be detected.

Figure 3:
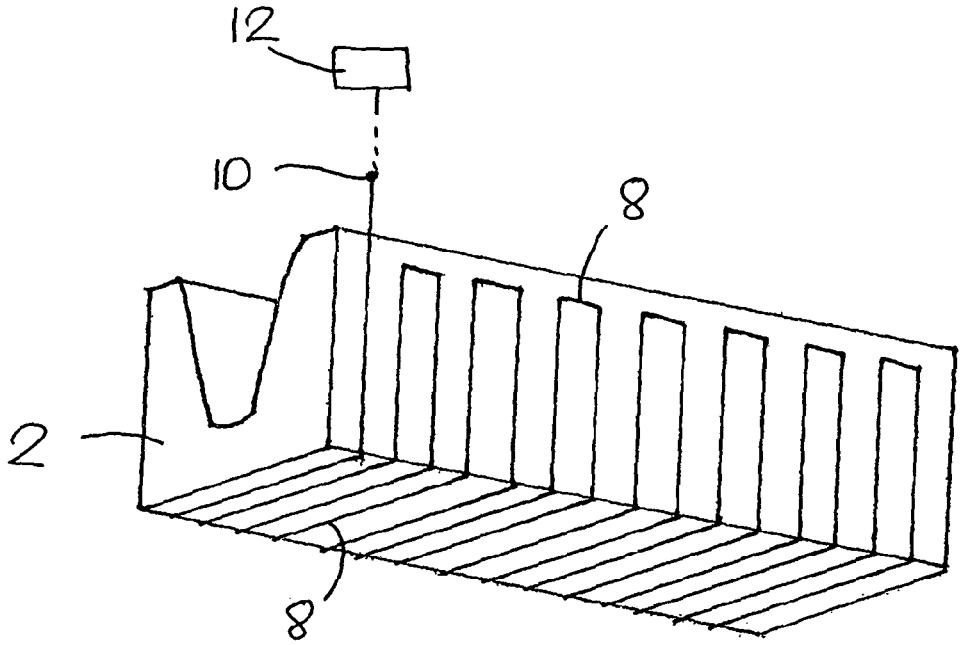
FIG. 3 is an isometric view of a trough body according to a second embodiment of the invention.

Any suitable wrapping pattern can be used, providing that the detector wire 8 does not cross over itself and the pitch between adjacent parts of the wire is reasonably small (for example, about 1-5 cm). In the embodiment of FIG. 2, the strands of wire 8 run backwards and forwards along the length of the trough body 2, covering first one side, then the base, and finally the other side. In the alternative embodiment of FIG. 3, the wire 8 runs down one side, across the base and up the other side before returning in the opposite direction. In both examples, one end 10 of the wire extends upwards beyond the upper edge of the trough body 2 so that it can be connected to an external detector device 12. The other end of the wire (not shown) is embedded within the filler layer 6.

The trough body 2, the metallic shell 4, the filler layer 6 and the detector wire 8 together comprise a unitary structure that is separable from the other parts of the metal transfer device, which are described below. This unitary structure, which will be referred to herein as a trough cartridge 13, may be made and sold separately as a replaceable component of the metal transfer device.

The trough cartridge 13 may be manufactured as follows. First, the trough body 2 is formed or moulded into the "green state" from a suitable castable refractory material, and is then fired at an elevated temperature to produce a hard ceramic-like structure having the desired shape. The detector wire 8 is then attached to the external surface of the trough body 2 in the chosen wrapping pattern, for example using adhesive tape.

Next, the ends of the metallic shell 4 are sealed using heatproof boards. A castable refractory material is poured into the shell 4 to form the base part of the filler layer 6. The trough body 2 with the attached detector wire 8 is seated on this layer of filler material so that its upper edge is level with the upper edge of the shell 4. More filler material is then placed between the sides of the trough body 2 and the sides of the shell 4 to fill the remaining gap. Pressure and/or mechanical vibrations may be applied to compact the filler layer, which is then allowed to set. This assembly is then fired to drive out any remaining water.

During firing, the adhesive tape holding the detector wire 8 to the trough body 2 is burnt away, leaving the wire embedded in the filler layer 6 adjacent the outer face of the trough body 2.

The outer part 14 of the metal transfer device includes a metal outer casing 15, which is made for example of steel and comprises a base 15*a* and two side walls 15*b* forming a U-shaped channel. A base layer 16 of thermal insulating material, for example low density fibre board, fills the lower part of this channel and supports the trough cartridge 13.

Mounted within the casing 15 adjacent the sides of the trough cartridge 13 are a pair of heater panels 18, each comprising an electrical heating element embedded within a ceramic support matrix. These heater panels 18 can be moved horizontally within the casing 15 towards or away from the trough cartridge 13 and can be clamped in the chosen position. During operational use, the heater panels 18 are positioned against the metallic shell 4 of the trough cartridge 13, to ensure efficient transfer of heat from the heater panels through the shell 4 and the thermally conductive filler layer 6 into the trough body 2. The heater panels 18 can also be moved away from the trough cartridge 13 to allow removal and replacement of the trough cartridge 13.

Each heater panel 18 includes on its outer face an insulating layer 20 of a suitable thermal insulating material, for example low density fibre board. An air gap 22 is provided between the insulating layer 20 and the adjacent side wall 15*b* of the casing to allow for sideways displacement of the heater panel 18, and further to reduce heat transfer to the casing 15. The upper parts of the trough cartridge 13, the casing 15 and the heater panels 18 are covered by a pair of steel top plates 24, each top plate 24 being thermally insulated by an upper layer of insulating material 26, for example a ceramic fibre blanket or low density fibre board. The top plates 24 are either removable or attached to the casing by hinges so that they can be removed or repositioned to allow access to the interior of the metal transfer device, for example for removal and replacement of the trough cartridge 13 or adjustment or maintenance of the heating panels 18.

A complete launder system consists of a number of individual metal transfer devices as described above, which are joined end-to-end to form a continuous channel 3 through which liquid metal can flow. Before pouring the liquid metal, each metal transfer device 1 is pre-heated by supplying electrical current to the heater panels 18, so that the trough body 2 reaches a desired temperature. Usually, this temperature will be close to the temperature of the liquid metal, so that the trough body 2 experiences little or no thermal shock when the metal is poured. Preheating the metal transfer device 1 also ensures that the liquid metal loses little or no heat as it flows through the device. The high thermal conductivity of the filler layer 6 ensures efficient heat transfer from the heater panels 18 to the trough body 2.

The metal transfer device 1 is intended primarily, but not exclusively, for use with non-ferrous metals, for example aluminium or zinc and alloys of those and other non-ferrous metals. It may however also be used for ferrous metals, for example steel.

If the device is intended for use with aluminium or zinc alloys, the trough body 2 may be made for example of a refractory material based on silicon dioxide (fused silica), which has a very low coefficient of thermal expansion and is therefore resistant to thermal shock. This makes it particularly suitable for use in applications where the heaters are frequently turned on and off.

If more aggressive alloys are to be used, such as those containing lithium or magnesium, fused silica may be an unsuitable material for the trough body 2, as it is reduced (eroded) very quickly by these metals. For these applications, it may be preferably to use a refractory material based on alumina (aluminium oxide), which is inert and therefore has much greater resistance to erosion. Normally, alumina would not be considered for use as a trough body material as it has a higher coefficient of thermal expansion and is therefore more vulnerable to thermal shock. However, in the present invention the risk of thermal shock is greatly reduced by the possibility of preheating the device.

For applications in which the temperature of the metal has to be actively controlled, for example in continuous casting operations, it may be preferable to use a refractory material based on silicon carbide for the trough body as this has a very high thermal conductivity, thus ensuring efficient transfer of heat form the heaters.

For each of these applications, the filler material should have a high thermal conductivity to ensure efficient heat transfer. A silicon carbide based refractory material is a suitable choice for most applications.

Notwithstanding the advantages provided by preheating the device, it is possible that in time the trough body 2 may crack or fail, allowing liquid metal to leak from the channel 3 towards the heating panels 18 (there being a tendency for liquid metal to flow towards the source of heat). However, as soon as the liquid metal reaches the detector wire 8 at the interface of the trough body 2 and the filler layer 6, it will connect the wire 8 electrically to the ground (the liquid metal being electrically grounded). The detector unit 12 is designed to apply a small voltage to the detector wire 8 and detects a current when the wire is connected to ground. It then generates an alarm signal to alert the operator that a leak has been detected.

In addition, if a leak takes place, the leaking metal is prevented from reaching the heater panels 18 first by the filler layer 6 and then by the metallic shell 4. The risk of damage to the outer parts of the metal transfer device 1 is therefore greatly reduced.

Once a leak has been detected, the trough cartridge 13 in the leaking section of the launder system can be easily removed and replaced, without having to replace the outer parts of the metal transfer device 1.

While the invention has been described largely in connection with its use as a launder system, it will be readily understood that the principals of design and the physical configuration of the device is readily applicable to other liquid metal handling devices, such as holders, crucibles and filters.

It will be apparent to those skilled in the art that the invention as described may be varied in many ways without departing from the spirit and scope of the invention. Any and all such modifications are intended to be included within the scope of the invention as claimed.

The invention claimed is:

1. A metal transfer device comprising a. a cast trough body that comprises a vessel for receiving liquid metal;

b. a heater for heating the trough body;

c. a detector for detecting leakage of liquid metal from the trough body, wherein the detector comprises an electrically conductive element located adjacent an outer surface of the trough body;

d. an outer casing located externally of the heater; and e. an insulating layer located between the heater and outer casing.

2. The metal transfer device according to claim 1, further including a filler layer between the trough body and the heater.

3. The metal transfer device according to claim 2, wherein the detector is embedded within the filler layer.

4. The metal transfer device according to claim 2, wherein the refractory material of the filler layer has a thermal conductivity of at least 3 W/m·K.

5. The metal transfer device according to claim 2, wherein the refractory material of the filler layer is based on silicon carbide.

6. The metal transfer device according to claim 2, including a metallic shell between the filler layer and the heater.

7. The metal transfer device according to claim 6, wherein the metallic shell and any components of the device located internally of the shell are separable from any components of the device located externally of the shell.

8. The metal transfer device according to claim 1, further including an air gap between the insulating layer and the outer casing.

9. The metal transfer device according to claim 1, further including a top cover.

10. The metal transfer device according to claim 9, further including an insulating layer located beneath the top cover.

11. The metal transfer device according to claim 2, wherein the filler layer comprises a cast refractory material having a high thermal conductivity.

* * * * *